US005129811A

United States Patent [19]

Grothe

[11] Patent Number: 5,129,811

[45] Date of Patent: Jul. 14, 1992

[54] CONTINUOUS-CASTING PLANT HAVING A MOLD-OSCILLATING DEVICE

[75] Inventor: Klaus Grothe, Monheim, Fed. Rep. of Germany

[73] Assignee: Mannesmann Aktiengesellschaft, Düsseldorf, Fed. Rep. of Germany

[21] Appl. No.: 562,464

[22] Filed: Aug. 3, 1990

[30] Foreign Application Priority Data

Aug. 3, 1989 [DE] Fed. Rep. of Germany ..... 3925939

[51] Int. Cl.[5] ..... B28B 1/08

[52] U.S. Cl. ..... 425/425; 164/416; 164/478; 425/432

[58] Field of Search ..... 164/416, 478; 425/424, 425/425, 432, 434, DIG. 5

[56] References Cited

U.S. PATENT DOCUMENTS

| | | | |
|---|---|---|---|
| 3,461,950 | 8/1969 | Michelson | 164/416 |
| 4,210,197 | 7/1980 | Hargassener et al. | 164/416 |
| 4,215,739 | 8/1980 | Borghorst | 164/416 |
| 4,480,678 | 11/1984 | Cazaux et al. | 164/416 |
| 4,540,037 | 9/1985 | Langner | 164/416 |
| 4,566,526 | 1/1986 | Fastert | 164/416 |

FOREIGN PATENT DOCUMENTS 62-3853 1/1979 Japan .

*Primary Examiner*—Jay H. Woo
*Assistant Examiner*—W. J. Matney, Jr.
*Attorney, Agent, or Firm*—Cohen, Pontani, Lieberman & Pavane

[57] ABSTRACT

A continuous-casting plant having a mold-oscillating device is disclosed. In such plant one of a mold and a frame-like mold lift table bearing a mold is connected via connecting rods to eccentrics arranged on a shaft that is driven in rotation, with the stroke of the oscillation of said eccentrics being adjustable, the eccentrics being different eccentricities, and the connecting rods acting on defined points of attack of the mentioned one of the mold and lift table. At least two connecting rods are provided for each point of attack, with each connecting rod being connected to one eccentric. Each connecting rod of a point of attack is provided with a respective piston. The corresponding eccentrics of each point of attack which determine the stroke are connected in force-locked manner to the mentioned one of the mold and lift table via coupling means.

6 Claims, 3 Drawing Sheets

CONTINUOUS-CASTING PLANT HAVING A MOLD-OSCILLATING DEVICE

BACKGROUND AND SUMMARY OF THE INVENTION

The present invention relates to a continuous-casting plant having a mold oscillating device, a frame-like mold lift table bearing a mold or the mold itself being connected via a connecting rod to eccentrics arranged on a shaft that is driven in rotation, the stroke of oscillation being adjustable and the connecting rod acting at defined points of attack on the lift table or mold respectively.

From European Patent 0,207,055 a mold oscillating device is known that is provided with stroke adjustment. Proceeding from a shaft that is driven in rotation and has eccentric bushings, the oscillation of the mold is, in this case, effected by connecting rods mounted on said shaft and connected via attachment means to the mold lift table. The stroke is adjusted in this known plant by the turning of the eccentric bushing with respect to the shaft which is driven in rotation. The position of the eccentric bushing, which corresponds to the selected stroke with respect to the eccentric part of the shaft, can be fixed by means of a flange and counterflange by connecting pieces which pass through them. The time-consuming refitting upon a change in the stroke is disadvantageous.

It is an object of the present invention to eliminate the foregoing disadvantage and to create a mold-oscillating device of the type described above which makes possible rapid and reliable changes of the stroke.

The foregoing object is achieved in accordance with the invention, in which a continuous-casting plant having a mold-oscillating device is provided. The device is arranged in the manner that at least two connecting rods are provided for each point of attack; that each of the connecting rods is connected to a separate eccentric, the eccentrics being of different eccentricity; that each connecting rod of a point of attack is provided with a piston; and that the corresponding eccentrics of each point of attack which determine the stroke are connected in force-locked manner via coupling means to the lift table or the mold. The attainment of the above-mentioned object in accordance with the invention has the advantage that the stroke can be adjusted very quickly, even though at standstill. One advantageous construction is characterized by the fact that the piston has a lateral projection and the coupling means between eccentric and lift table or mold consist of cylinders with rams arranged displaceably therein, the cylinders being attached to the lift table or the mold, while the ram can be pressed against the front end of the piston and the piston can be fixed against an abutment via the projection. One of the abutments is fixed in position, i.e. firmly attached to the cylinder. Each additional abutment consists of a displaceable annular ram and is thus displaceable. Rams and annular rams can be acted on hydraulically. The cylinders of all points of attack which are associated with the same stroke are connected in each case to a control circuit.

BRIEF DESCRIPTION OF THE DRAWING FIGURES

The foregoing and further objects and advantages of the present invention will become apparent from reading the following detailed description of the invention in connection with the accompanying drawing figures, in which.

DETAILED DESCRIPTION OF THE PREFERRED EMBODIMENT

Figure 1:
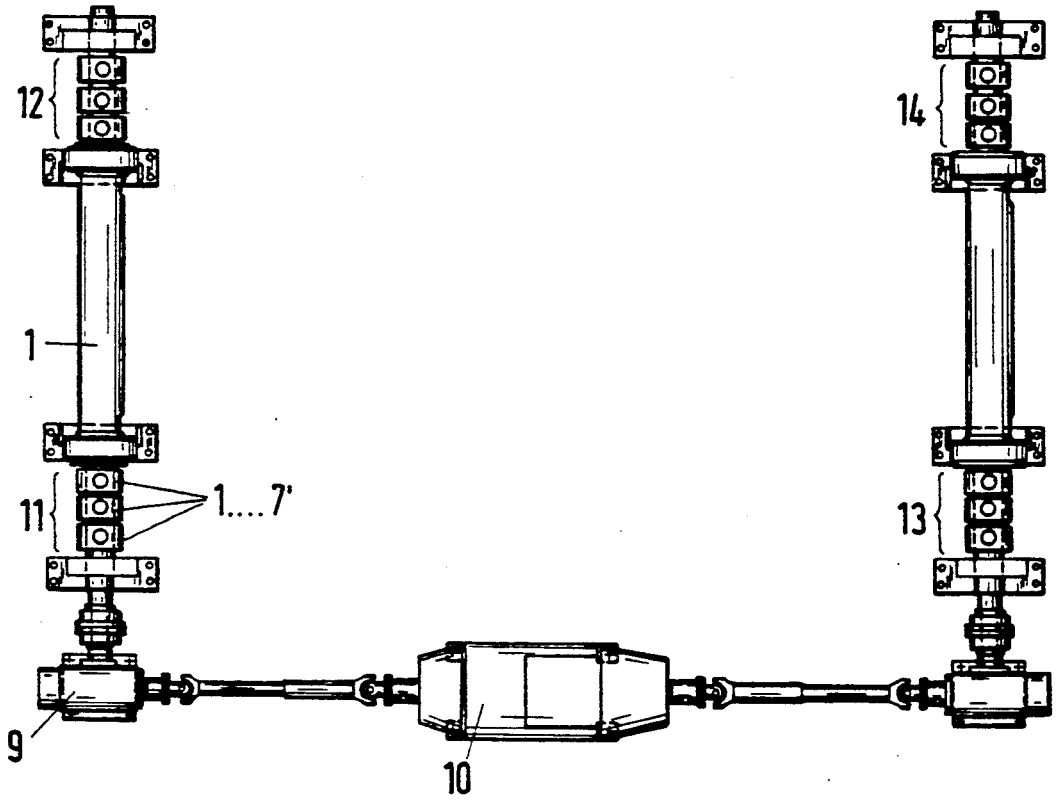
Fig. 1 PRIOR ART
FIG. 1 is a plan view showing an application of the invention in a square arrangement that is per se known.
Figure 2:
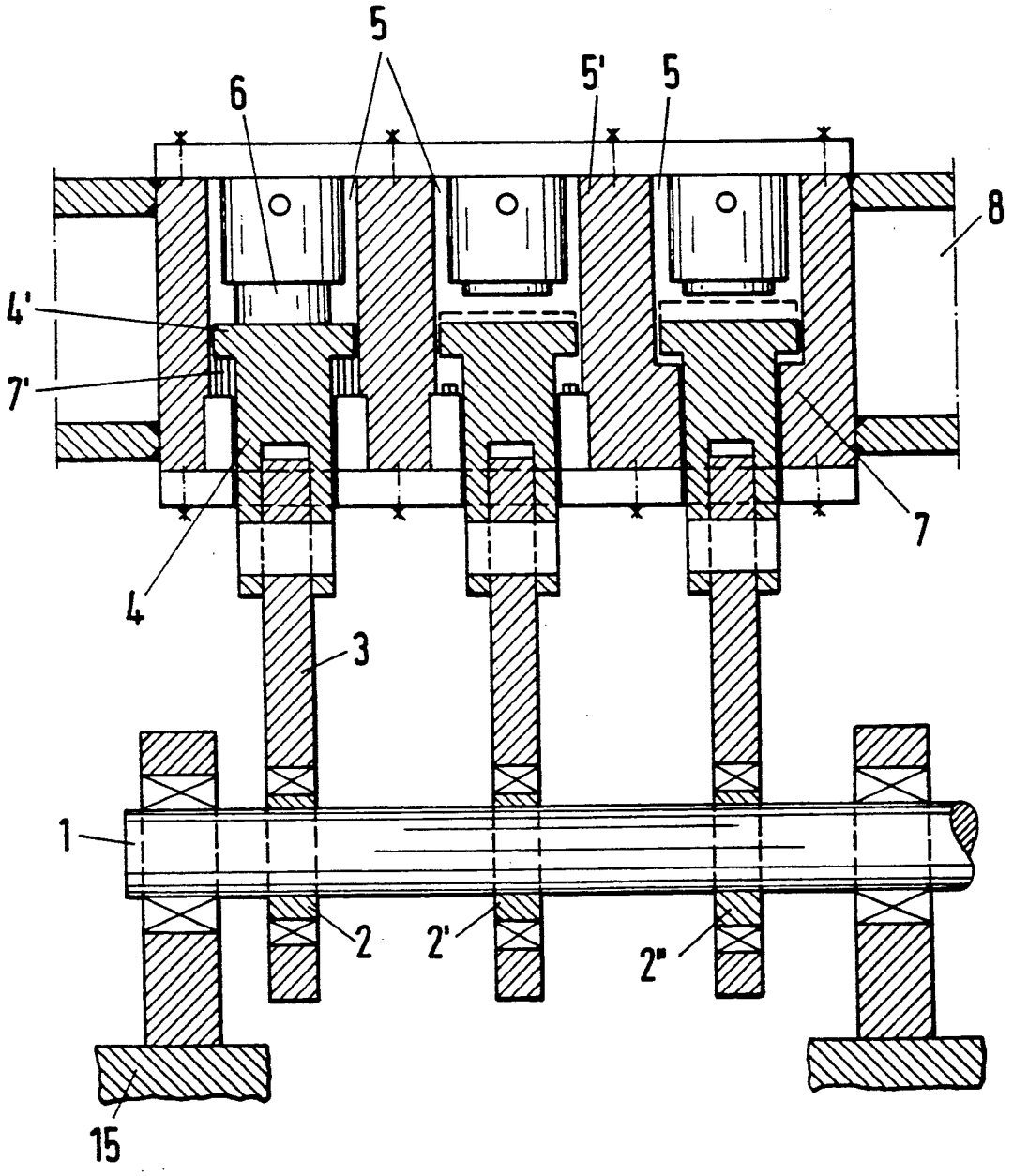
FIG. 2 is a diagrammatic cross-section view of an embodiment of the invention.

With reference to FIGS. 1–2, it is known to develop a lift table 8, in which a mold is arranged, as a square frame and to effect the force-locked connection—hereinafter referred to as points of attack—to an eccentric shaft 1 in each case at the corners of the lift table. FIG. 1 shows application of the invention in a square arrangement that is per se known. Two parallel eccentric shafts fixedly mounted on a support frame 15 (FIG. 2) are driven via corner gearings 9 by a drive motor 10 having power takeoffs on both sides. Each of the four points of attack 11, 12, 13, 14 consists in the embodiment shown of an eccentric unit described herein as the invention. Pistons having the same stroke at all points of attack are preferable connected to a single remote-controlled control circuit (not shown).

Figure 3:
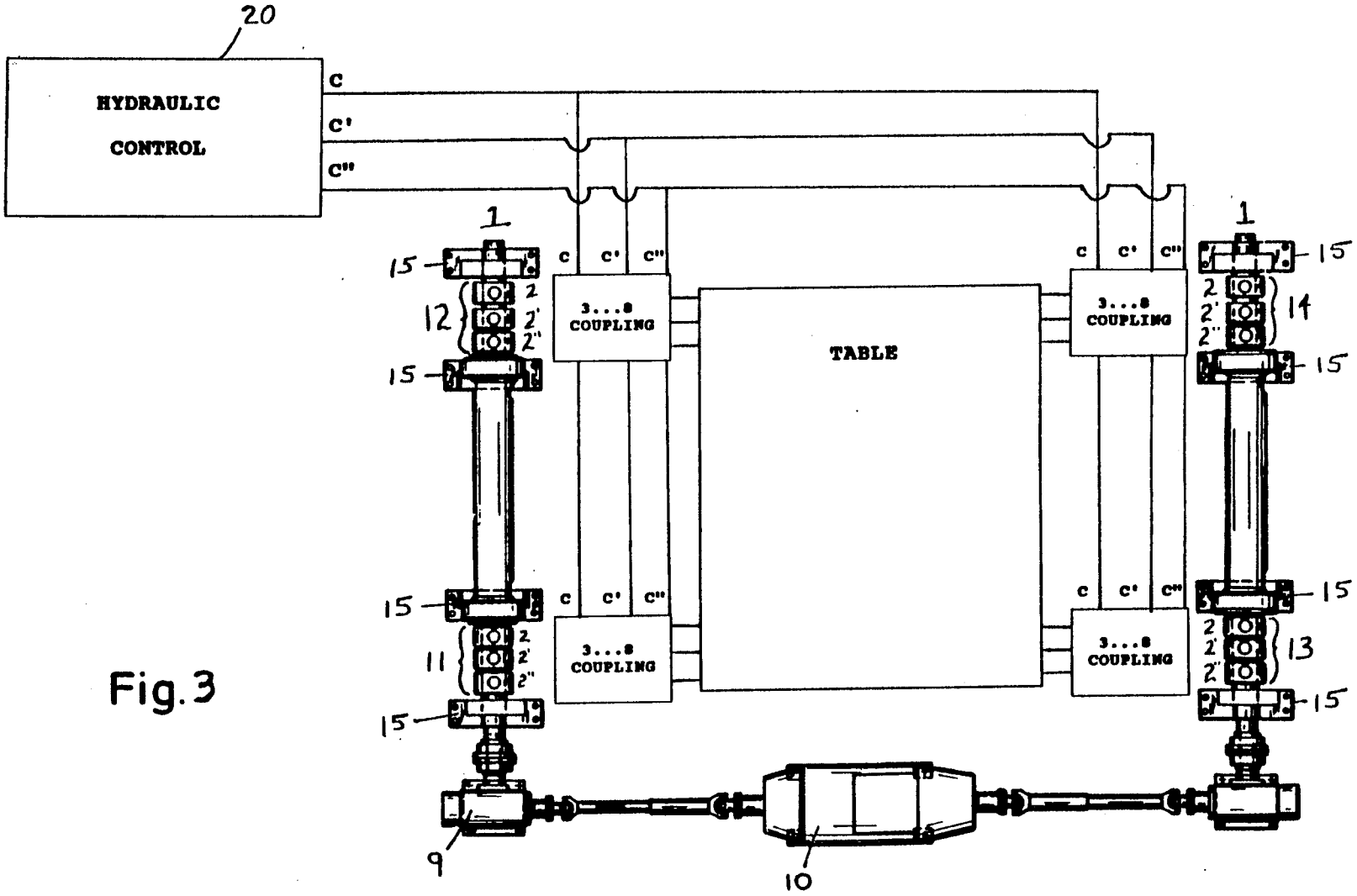
FIG. 3 is a schematic diagram of a control system of the present invention.

The invention will be explained in further detail below with reference to the diagrammatic cross-sectional view of FIG. 2. In this embodiment different eccentricities have been achieved by an arrangement of eccentric bushings 2, 2', 2'' of different eccentricity on the eccentric shaft 1 that is driven in rotation, the eccentric bushings being firmly connected to the eccentric shaft driven in rotation. The eccentric bushings 2, 2', 2'' are connected via bearings to the connecting rods 3 which, in turn, are connected to pistons 4. Upon the turning of the eccentric shaft 1, the pistons 4 execute a stroke. The strokes of the pistons differ according to the different eccentricities of the eccentric bushings. The pistons enter cylinders 5, which contain coupling rams 6 displaceably arranged therein. The selection of the stroke takes place via the selection of the cylinder in which the piston having the corresponding eccentricity is guided. The cylinder selected actuates the ram 6 contained therein and presses it against the front end of the piston, the piston being pressed via its lateral projection 4' against the abutment 7 or 7'. The frictional securing of the piston, both at its front and on the lateral projection, assures a frictional coupling to the mold lift table or the mold, during both the upward and the downward movement of the oscillation. The cylinders 5 arranged for each point of attack are advisedly developed as a coherent cylinder block 5', or eccentric unit. The abutments 7, 7' in the cylinder block 5' consist of annular rams arranged therein; that abutment which is associated with the piston of largest eccentricity per eccentric unit being developed as a rigid abutment 7. To make this possible, the different eccentrics arranged for each point of attack on the shaft, which is driven in rotation, are arranged in equal phase. The action on the rams 6 and annular rams 7' by the hydraulic means indicated in the embodiment can also take place with the same effect by magnetic or electrical means or by a motor. FIG. 3 schematically shows that control of the present invention. The hydraulic control 20 produces three signals, designated C, C', and C'', which correspond to the eccentrics 2, 2' and 2'', respectively. These control signals are arranged so that the cylinders 5 in each of the four points of attack 11, 12, 13 and 14, i.e. the points of attachment, having the same stroke are connected to the same control circuit.

Due to the fact that all eccentrics are arranged with the same phase, precise vertical oscillation of the lift table, or of the mold is assured. This means that the mold does not experience any wobbling movement which would lead to billet breakouts or at least to a poor quality of the billet. If an arc-type mold is to be used, the cylinders can be coupled at the points of attack via control circuits in such a manner that they oscillate with the same stroke only in pairs. In one special case this means that the stroke must be set larger at the points of attack 11 and 13 which are associated with the outer radius of curvature of the arc-type mold, and correspondingly smaller at the points of attack 12 and 14 which are associated with the inside radius of curvature of the arc-type mold. With every possible setting, there is assured a dependable and precise oscillation of the mold lift table or the mold itself, which oscillation follows the radius of curvature of the arc-type mold and is adjustable as to stroke.

It should be understood that the preferred embodiments and examples described are for illustrative purposes only and are not to be construed as limiting the scope of the present invention which is properly delineated only in the appended claims.

What is claimed:

1. A continuous-casting mold-oscillating device, for oscillating a structure comprising a mold having at least one attachment point for oscillation, comprising:

a plurality of eccentric cams each having a different eccentricity mounted on a rotatable shaft, each being attached to a first end of a connecting rod, each of said connecting rods being attached at a second end to a piston, and each of said pistons being associated with the attachment point, so that when said shaft rotates, each said eccentric cams cause said pistons to oscillate over a different stroke path; and coupling means for selectively coupling one of said pistons to said structure, so that when said selected piston oscillates, said structure also oscillates, over one of said different stroke paths.

2. The mold-oscillating device according to claim 1, wherein each of said pistons has a lateral projection.

3. The mold-oscillating device according to claim 2, wherein:

said coupling means comprises cylinders with rams selectively displacable arranged therein so that each is selectively pressed against a front surface of one of said pistons;

said cylinders are attached to the structure; and each of said pistons is arranged such that it is fixed against a respective abutment by means of said lateral projection.

4. The mold-oscillating device according to claim 3, wherein one of said respective abutments is rigid and each additional abutment consists of a selectively displaceable annular ram.

5. The mold-oscillating device according to claim 4, wherein said rams and said annular rams are displaced by hydraulic cylinders.

6. The mold-oscillating device according to claim 3, further comprising a plurality of coupling means, each associated with a respective attachment point on the structure, wherein each of said coupling means has associated with it an eccentric cam which defines a same path of oscillation of said pistons, and a control circuit for controlling the selective pressing of an associated ram against said piston so as to fix a piston against a respective abutment, arranged so that all eccentric cams associated with said same path of oscillation at all points of attachment are coupled to the structure simultaneously.

* * * * *